US005318818A

United States Patent [19]

Sjöström

[11] Patent Number: 5,318,818

[45] Date of Patent: Jun. 7, 1994

[54] STRIP OF MATERIAL

[75] Inventor: Anders Sjöström, Lund, Sweden

[73] Assignee: Tetra Laval Holdings & Finance S.A., Pully, Switzerland

[21] Appl. No.: 20,784

[22] Filed: Feb. 22, 1993

[30] Foreign Application Priority Data

Mar. 3, 1992 [SE] Sweden ..... 9200638-6

[51] Int. Cl.[5] ..... B32B 3/04; B32B 3/08

[52] U.S. Cl. ..... 428/43; 428/124; 428/192; 229/123.2; 229/160.2; 383/205; 493/930

[58] Field of Search ..... 428/43, 124, 192; 229/123.2, 160.2; 383/205, 206; 493/923, 930

[56] References Cited

U.S. PATENT DOCUMENTS 4,787,507 11/1988 Rausing ..... 428/483

FOREIGN PATENT DOCUMENTS 402899 7/1978 Sweden .

558283 1/1975 Switzerland .

*Primary Examiner*—Alexander S. Thomas

*Attorney, Agent, or Firm*—Burns, Doane, Swecker & Mathis

[57] ABSTRACT

Strips of material for manufacture of packaging containers are sometimes provided with aids to opening in the form of pull tabs (3), which extend transversely across the strip of material (1) When the tab (3) is folded round one longitudinal side of the strip (1) damage to the projecting tab parts is prevented by the fact that the fold is made round a part of the rear edge (4) which is provided with a cut-out (7) in the form of an arc of a circle. This is particularly important when the strip is formed into a roll, since the tab parts which project outside the end surface of the roll can easily be damaged during handling of the roll.

7 Claims, 1 Drawing Sheet

STRIP OF MATERIAL

The present invention concerns a strip of material for manufacture of packaging containers with an opening device containing a pull tab.

Packaging containers of disposable type for packaging of liquid foods. e.g. milk or juice, are usually manufactured from a laminated packaging material which contains layers of paper, plastic and possibly gas barrier material. The packaging material has the form of a strip or single sheet, which is formed by bending and sealing into watertight, parallelepiped-shaped packaging containers. A typical, known machine for manufacture of watertight, parallelepiped-shaped packaging containers from a strip of packaging laminate is shown in American patent U.S. Pat. No. 4,580,392.

Packaging containers of the above type are provided with various types of opening devices. A known one uses a pull tab of which one end is detachably connected to the outside of the packaging container so that the pull tab can be used by the consumer to tear a part of the packaging container, usually along a seal in the upper part of the packaging container. Tabs of this type are applied to the strip material at the same time as its manufacture, after which the strip of material is rolled up into rolls, which are handled and possibly stored before they are transported to the packaging machine in which the strip of material is to be formed into packaging containers. Since the pull tab must be accessible from the outside on the finished packaging container, i.e. it must pass through a sealing joint on the packaging container, it must be so placed on the strip of material that it extends over the surface of the strip of material which is later turned towards the inside of the packaging container and at least out to the longitudinal edge of the strip of material. When the strip of material has the form of a roll of material, one side surface of the roll will thus exhibit more or less projecting parts of the pull tabs, which in that case are easily damaged when the roll is handled during transport, storage and positioning in the packaging machine. The problem can be solved by the sides of the roll being clad with some protective material, e.g. discs of corrugated cardboard, but these are large and unmanageable and in addition increase the amount of waste material which must be dealt with.

An aim of the present invention is to provide an arrangement which makes it possible to reduce or completely eliminate the risk of damage to pull tabs located at the end or side surfaces of the rolled strip of material.

A further aim of the present invention is to provide a strip of material fitted with pull tabs in which the pull tabs, after application to the strip of material, do not project with any part beyond one longitudinal edge of the strip of material.

A further aim of the present invention is to provide a strip of material of the said type which can be manufactured without significant increase in labour input or cost.

The above and other aims have been achieved according to the invention through the fact that a strip of material for manufacture of packaging containers with an opening device containing a pull tab is given the characteristic that the pull tab extends mainly transversely over a part of one side surface of the strip of material, round one longitudinal edge of the strip of material and mainly transversely over a part of the other side surface of the strip of material, with the said edge exhibiting a cut-out for the pull tab.

Preferred embodiments of the strip of material according to the invention have further been given the characteristics that can be seen from the sub-claims.

Through providing one longitudinal edge of the strip of material with a cut-out of such size that the tab or, to put it better, the folded part of the tab does not extend with any part beyond the edge of the strip of material the problem of the parts of the tab which extend beyond the side surface on a roll which is formed of the strip of material is avoided in a simple manner. The solution is simple and uncomplicated and avoids the need for protective packing or the like.

A preferred embodiment of the strip of material according to the invention will now be more closely described with reference to the enclosed schematic drawing, which only shows the details indispensable for understanding the invention.

Figure 1:
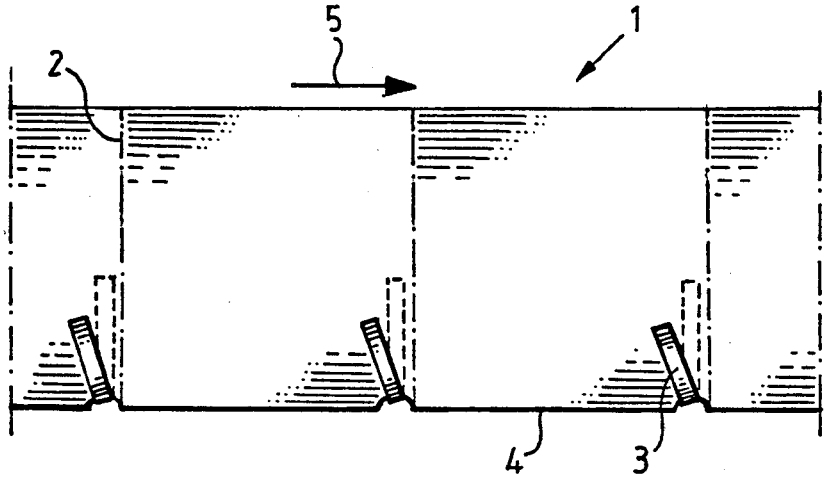
FIG. 1 shows a part of a strip of material according to the invention.

The strip of packaging material 1 shown in FIG. 1 is made of a flexible laminate which contains layers of fibrous material, which are covered on both sides with homogeneous plastic material, preferably thermo-plastic. The strip of material can also contain other layers of e.g. gas barrier material such as aluminium foil or other types. When the strip of material is intended for manufacture of e.g. parallelepiped-shaped packaging containers of the type which is manufactured by means of the packaging machine which is shown in American patent U.S. Pat. No. 4,580,392 the strip of material contains a pattern of fold lines which facilitate the bending and shaping of the packaging material into the packaging container. For each packaging container a length of material is used which corresponds to the distance between two transverse cut lines 2 marked in FIG. 1. The cut lines are only imaginary lines at which the material will later be separated. The tube of material described is thus suitable for manufacture of e.g. parallelepiped-shaped packaging containers, but the type of material and the type of packaging material are of no importance for the present invention. The essential thing is only that the strip of material according to the invention exhibits applied pull tabs 3, which extend with a least a part transversely in relation to the longitudinal direction of the strip of material 1. The pull tabs 3 are placed in an identical manner along each one of the previously mentioned imaginary cut lines 2. The length of the pull tabs can vary depending on the type of packaging container and depending on the size of the openable area which the tearing off of the pull tab 3 is intended to open. A typical packaging container of the type which contains an opening device with a pull tab is shown in American patent U.S. Pat. No. 4.787.507.

Figure 2:
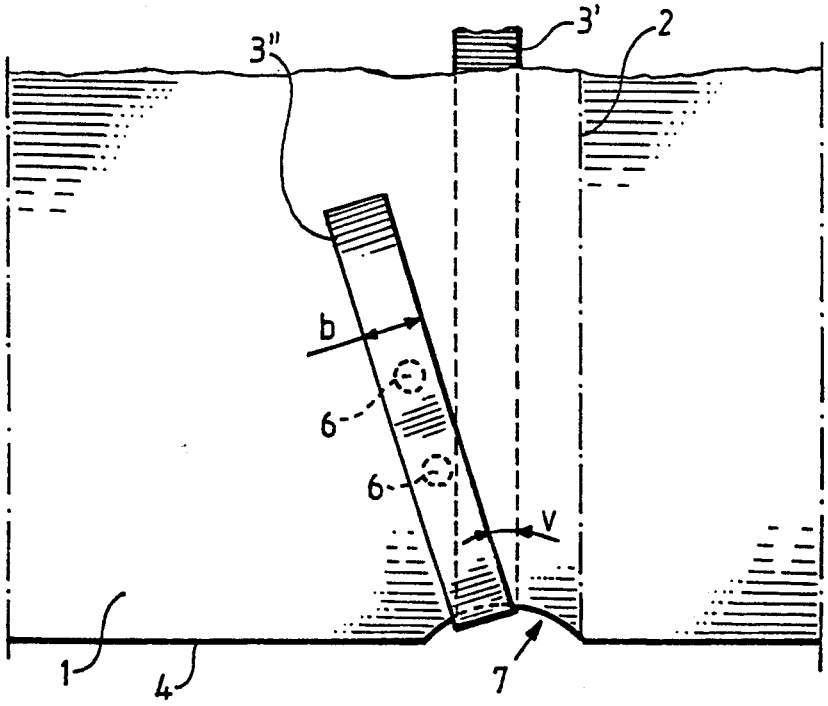
FIG. 2 shows on a larger scale a part of the strip of material according to the invention provided with a pull tab.

In FIG. 2 there is shown on a larger scale how the pull tab 3 according to the invention is placed and folded over the edge of the strip of material 1. The pull tab 3 comprises two parts, namely a part 3', which extends transversely over and is fixed to the surface of the strip of packaging material 1, which after shaping of the strip of material 1 into individual packaging containers is turned towards the inside of the packaging container.

The tab part 3 has a length which corresponds to the length of the openable area. After shaping the strip of material 1 into individual packaging containers the tab section 3' will be located in a transverse seal in the upper part of the packaging container, more precisely between the two layers of thermo-plastic material sealed to each other which cover the inside of the strip of material. If desired the strip of material 1 can also be provided with a tear perforation, which extends along the tab section 3'. But this is not shown in the drawing.

The other end of the pull tab 3 forms a tab section 3", which extends mainly transversely at a certain angle in relation to the longitudinal direction of the strip of material 1. The pull tab 3 is, however, folded over one longitudinal edge 4 of the strip of material 1, with the folded tab section 3" being detachably connected to the outside of the strip of material 1, i.e. the side of the material which after the shaping into individual packaging containers forms the outside of the packaging. Hereinafter the expressions "inside" and "outside" will be used to designate the two sides of the strip of material. The tab section 3" may extend at a 90° angle to the edge 4, but is preferably detachably connected to the outside of the packaging material in such a way that it extends in an angle v to the tab section 3', i.e. to a line extending at right angles across the strip of material 1. The angle v preferably amounts to between 10°-60°, and a particularly advantageous embodiment from the handling and openability standpoint is achieved if the angle is mainly 30°. The tab section 3" is here angled in such a direction that it extends backwards in relation to the machine direction, i.e. in relation to the direction in which the strip of material runs during shaping into individual packaging containers in the packaging machine. The machine direction is marked with an arrow 5 in FIG. 1. Through angling the tab section 3" slightly backwards in relation to the machine direction one avoids the tab section 3" sticking or being damaged in any other way during the forward feed of the strip of material 1. The tab section 3" is, as previously mentioned, detachably connected to the outside of the strip of packaging material, and preferably this is done through spot heating so that the tab section 3" is connected at sealing points 6 to the outer plastic layer of the strip of packaging material 1. The outermost end of the tab section 3", facing away from the edge 4 of the strip of material, is preferably without sealing points so that the end is easily accessible for the consumer when the packaging container is to be opened.

According to the invention the edge 4 of the strip of packaging material 1 exhibits a number of cut-outs 7 for the pull tab 3, and these cut-outs are placed at even intervals along the edge 4 of the strip of material which is provided with the tabs, mainly at the ends of the imaginary cut lines 2. The placing of the cut-outs 7 will thus coincide with thew placing of the pull tabs 3 so that these end up with their part folded over the edge 4 mainly in the middle of the cut-out 7, which preferably has the form of an arc of a circle. The folding and attaching of the tab section 3" of the pull tab 3 to the outside of the packaging material entails, particularly when the angle v is selected relatively large, that a section of the folded part of the pull tab 3 projects beyond the fold area proper, which, however, is of no importance, since the cut-out 7 ensures that the tab is situated completely within the actual edge line 4. A precondition for this is, however, that the cut-out 7 has sufficient depth, and the minimum depth is simply defined by the formula sine v×b, where v is the previously mentioned angle of fold between the two parts of the tab and b is equal to the width of the tab. Preferably the cut-out 7 is made somewhat deeper in order to ensure the desired result even if the fold of the tab 3 is not made in immediate contact with the arc-shaped part of the edge line 4 situated in the cut-out 7. With a typical tab width of 6 mm this gives a minimum cut-out depth of c. 2 mm.

A strip of material 1 which is provided with applied pull tabs 3 folded in cut-out 7 according to the invention will, in the rolled up state, form a compact roll of material, of which one side surface is completely devoid of projecting parts of the pull tabs 3. The side surface is instead provided with the cut-outs 7, which, however, are so small and few that in relation to the original edge line 4 they only occupy a small part of the side of the roll and in no way weaken this or entail any other disadvantage. The making of the cut-outs 7 is preferably done at the same time as the cutting of the edge of the strip of material 1 or immediately afterwards, i.e. at that moment of work when the width of the strip of material 1 is determined, which occurs before the application of the pull tabs 3.

Through the invention it is ensured that the pull tabs 3 are completely protected in all normal handling of the rolled up strip of material. The strip of material therefore does not require any protective layer at the side surfaces, but can be handled precisely like a roll not provided with pull tabs, i.e. merely covered with a layer of shrink film or the like to protect it from dirt.

While this invention has been illustrated and described in accordance with the preferred embodiment, it is recognized that variations and changes may be made therein without departing from the invention as set forth in the claims.

I claim:

1. A strip of material for the manufacture of packaging containers having an opening device including a pull tab, the strip of material comprising:

a strip of material having a first side surface and a second side surface and a longitudinal edge, the edge having one or more cut-outs formed therein, the cut-outs being in the form of a cut extending inwardly from a line defined by the edge of the strip of material;

a pull tab attached to the strip of material, the pull tab extending mainly transversely over a part of the first side surface of the strip of material, around the edge of the strip of material in one of the cut-outs, and mainly transversely over a part of the second side surface of the strip of material, a fold area of the pull tab being formed where the pull tab extends around the edge of the strip of material in one of the cut-outs, wherein the cut-outs are of sufficient depth that the fold area of the pull tab is disposed completely on one side of the line defined by the edge of the strip of material.

2. A strip of material according to claim 1, wherein the cut-out is an arc of a circle.

3. A strip of material according to claim 1, wherein a first end of the pull tab is fixedly connected to an inner side of the strip of material a second end of the pull tab is detachably connected to an opposite outer side of the strip of material.

4. A strip of material according to claim 3, wherein the second end of the tab extends at an angle v to the first end of the tab.

5. A strip of material according to claim 4, wherein angle v is between 10°–60°.

6. A strip of material according to claim 5, wherein angle v is approximately 30°.

7. A strip of material according to claim 4, wherein the depth of the cut-out is at least equal to sine v × width of the pull tab.

* * * * *